US007050902B1

(12) United States Patent
Bolz

(10) Patent No.: US 7,050,902 B1
(45) Date of Patent: May 23, 2006

(54) CONTROL SYSTEM FOR INTERNAL COMBUSTION ENGINE COMPRISING A SENSOR AND AN INTERFACE FOR DIGITISING MEASUREMENT VALUES

(75) Inventor: Stephan Bolz, Pfatter (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/622,696

(22) PCT Filed: Jan. 18, 1999

(86) PCT No.: PCT/DE99/00100

§ 371 (c)(1),
(2), (4) Date: Jan. 11, 2001

(87) PCT Pub. No.: WO99/42717

PCT Pub. Date: Aug. 26, 1999

(30) Foreign Application Priority Data

Feb. 20, 1998 (DE) ..... 198 07 215

(51) Int. Cl.
*F02D 41/24* (2006.01)

(52) U.S. Cl. ..... 701/114; 701/115; 73/23.31

(58) Field of Classification Search ..... 701/109, 701/114, 115; 123/697; 73/23.31, 23.32, 73/23.33; 702/24, 188; 361/709–711, 816, 361/818; 439/278, 279
See application file for complete search history.

(56) References Cited

U.S. PATENT DOCUMENTS

| | | | | |
|---|---|---|---|---|
| 4,214,472 | A * | 7/1980 | Maxwell et al. | 73/23.31 |
| 4,337,745 | A | 7/1982 | Pomerantz | 123/694 |
| 4,428,348 | A | 1/1984 | Takase et al. | 123/480 |
| 4,668,873 | A * | 5/1987 | Ohba et al. | 361/818 |
| 4,963,246 | A * | 10/1990 | Nakajima et al. | 204/406 |
| 5,024,534 | A * | 6/1991 | Matsubara et al. | 374/144 |
| 5,161,087 | A * | 11/1992 | Frankeny et al. | 361/710 |
| 5,869,744 | A * | 2/1999 | Suzuki et al. | 73/23.32 |
| 6,254,750 | B1 * | 7/2001 | Patrick et al. | 204/425 |

FOREIGN PATENT DOCUMENTS

| | | |
|---|---|---|
| DE | G 89 10 740.3 | 9/1989 |
| DE | 195 22 178 A1 | 11/1995 |
| EP | 0 277 006 A2 | 8/1988 |

OTHER PUBLICATIONS

JPO abstract for JP 58-150864, Sep. 7, 1983.

* cited by examiner

*Primary Examiner*—Andrew M. Dolinar
(74) *Attorney, Agent, or Firm*—Baker Botts L.L.P.

(57) ABSTRACT

A control system for an internal combustion engine has a motor control apparatus (1) and a sensor unit with an interface (21) to the motor control apparatus. An evaluating unit (211) is integrated into the interface for digitalizing measurements of the sensor.

2 Claims, 1 Drawing Sheet

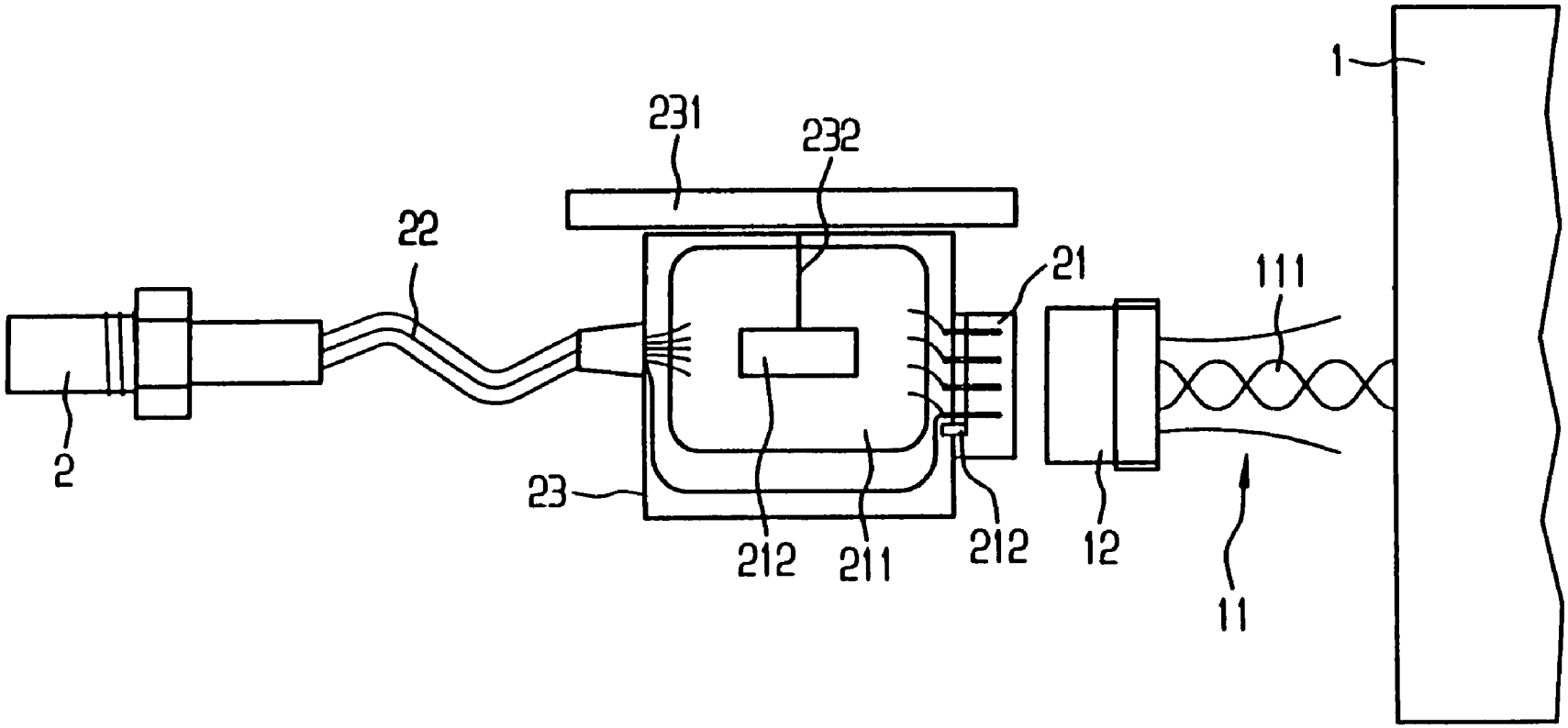
1
111
11
12
21
212
211
232
212
231
23
22
2

CONTROL SYSTEM FOR INTERNAL COMBUSTION ENGINE COMPRISING A SENSOR AND AN INTERFACE FOR DIGITISING MEASUREMENT VALUES

The invention relates to a control system for an internal combustion engine with a motor control apparatus and a sensor which has an interface to the motor control apparatus.

For the control of internal combustion engine in motor vehicles, measurements made by exhaust probes are often needed. On account of the high exhaust temperatures the unit for evaluating the measurements is regularly situated not directly in the exhaust probe but in the motor control apparatus.

Increasingly, a very high resolution of the measurements is necessary. An example is the operation of a storage catalyst which stores nitrogen oxide when the motor is running lean and there is an excess of oxygen ($\lambda>1$). If the nitrogen oxide concentration at the output of the catalyst increases, the nitrogen oxides stored in the storage catalyst must be reduced again by adjusting the fuel mixture to $\lambda \leqq 1$. For this purpose an extremely precise and reliable exhaust gas measurement of great resolution is required, which can register even a concentration of 10 ppm. This signifies that measurement streams in the order of 50 nA must be evaluated.

On account of the high working temperature at the location of the exhaust gas probe the corresponding evaluating unit is regularly contained in the motor control apparatus.

DE 195 22 178 A1 discloses a detector apparatus for oxygen concentration with an exhaust gas probe and a motor controller. The controller comprises a heating control for the exhaust probe, a stream analysis circuit for detecting a current picked up by the exhaust probe, an analog-to-digital converter to convert the current to a digital signal, and a microprocessor to process sensor signals and to control an internal combustion engine. Due to electromagnetic interference occurring in the engine compartment of a motor vehicle, and as a result of parasitic conductances and capacitances, only signals which exceed a certain level can be evaluated.

In German Gebrauchsmuster G 89 10 740 a hot film air mass sensor with a mounting is disclosed, in which a sensor chip together with an evaluating circuit is arranged as a sensor unit in the air stream to be measured.

It is an aim of the invention to produce a control system for an internal combustion engine and a sensor unit to permit an especially precise control or regulation of an internal combustion engine with respect to the maintenance of defined exhaust gas limit values.

This aim is achieved with a control system and a sensor unit as defined in the independent claims. Advantageous embodiments are specified in the subordinate claims.

By integrating the evaluating unit into the interface of the sensor high leakage resistances, as required for precise measurement, can be achieved. The signal path from the sensor all the way to the evaluating unit can be protected easily and lastingly against the penetration of moisture, so that the occurrence of parasitic conductances and capacitances can be minimized.

The sensor and the evaluating unit are combined in one functional unit.

A sometimes necessary plug connector for the sensor can be expanded by a housing to contain the evaluating unit.

The conductors necessary for connecting the sensor and interface can quite easily be made waterproof, and provided with tension relief and protection against kinking.

Since the sensor with the evaluating unit integrated into the interface has an "intelligent interface," communication between the motor controller and the evaluating unit can be provided through a system bus. Additional sensors which also have an evaluating unit on hand can be connected to such a system bus. The system bus permits a reduction of the number of conductors connected to the motor controller. Therefore there is also a reduction of the number of plug pins on the motor controller, which consequently can be made more compact.

Due to the transfer of digital signals between the interface of the sensor and the motor controller the system is made less sensitive to electromagnetic interference.

If the evaluating unit includes a microprocessor or a computer, an especially easy calibration of the sensor can be carried out. Furthermore, a software update is possible in a vehicle that has already been delivered to the customer.

Preferably the evaluating unit integrated into the interface is as close as possible to the sensor, but spaced away from it so that unfriendly ambient conditions in the area of the sensor will not cause any interference with the operation of the evaluating unit.

By integrating the sensor and the electronics (evaluating unit) an individual adjustment of the sensor and the electronics can be made to improve accuracy. The evaluating unit can regulate the sensor, for example by heating the sensor, and thus relieve the motor controller. Also, the evaluating unit can locally diagnose the functionality of the sensor. In case of a malfunction, the unit of sensor and interface, including the integrated evaluating unit, can easily be replaced without the need for adjustment to the motor controller.

Additional advantages, features and applications of the invention will be found in the description of the embodiment in conjunction with the drawing.

The FIGURE shows a control system with a controller and a sensor unit.

The interface 21 consists of a plug connector, an electrically conductive housing 23 for the plug connector and an evaluating unit 211 integrated into this connector housing. The housing 23 has a metal cooling surface 231 which can be configured as a cooling flange. The cooling surface 231 is connected through thermal path 232 to the surface of a power component 212. The evaluating unit 211 is made by casting it from plastic, e.g., silicone, together with the ends of signal-carrying connecting conductors 22, so that an optimum seal against moisture is achieved. In spite of the sealing compound, the thermal path 232 together with the cooling surface 231 provides for an adequate removal of heat.

The sensor and the evaluating unit form a functional unit, namely a sensor unit.

A water-repellent (hydrophobic) membrane in the housing 23 permits a supply of air through connecting lines 11 which lead to the motor control apparatus 1. The exhaust probe 2 is supplied with an oxygen reference through a connecting line 22 which serves for heating the exhaust probe 2, since the latter, in contrast to a signal line among the connecting lines 22, is not cast together with the evaluating unit 211.

The connecting lines 22 between the exhaust probe and the interface 21 are approximately 0.15 m to 0.5 m long. The connecting lines 11 between the interface 21 and the motor controller 1 are about 1.5 m to 5 m long. A good length for the connecting lines 22 to the probe 2, wherein on the one hand the electronics of the evaluating unit 211 is located far enough away from the heat-producing exhaust tract, without the occurrence of excessively great parasitic effects on the signal-carrying connecting lines 22, is about 0.3 m. Typically, then, the length of the connecting lines 11 between the interface 21 and the motor control 1 is approximately 2 m.

On account of the short distance between the interface 21 and the exhaust probe 2 the connecting lines 22 can easily be sealed against moisture and made safe against kinking. Therefore only extremely low parasitic conductances or leakage resistances occur in the range of more than 10 MΩ. Due to the short distance between the exhaust probe 2 and the interface 21, and more precisely the evaluation unit 211, the connecting lines 22 are not very sensitive to electromagnetic interference. The electromagnetic tolerance can be further improved if the connecting lines 22 are shielded. This is easily possible and inexpensive on account of the short distance which requires little flexibility.

The evaluating unit 211 according to the invention can easily detect currents of 50 nA and no noise or interference will prevent useful measurement results. The range of measurement of the nitrogen oxide probe extends down to 10 ppm.

The central component of the measuring and control electronics of the evaluating unit 211 is a microprocessor, and precisely a microcontroller with a nonvolatile memory and few hardware components. The latter include a voltage regulator to operate the microcontroller, a few active electronic components, and lastly an exhaust gas probe 2. Furthermore, the evaluating unit 211 has an impedance converter to adapt the high-resistance signals of the exhaust probe 2 to the impedance of an analog/digital converter integrated into the microcontroller. By means of a digital/analog converter the signals to be put out at the interface 21 to the connecting lines 22 are measured again so as to produce control signals for the operation of the exhaust probe and a reference signal.

Furthermore, the evaluating unit 211 has a generator to produce a test signal which serves for the indirect determination of the probe temperature by determining the probe impedance. Moreover, the evaluating unit 211 includes a power component for controlling the heating of the exhaust probe by pulse-width modulation (PWM). The microcontroller controls the pulse width by the power component such that the probe temperature remains within the allowable working range. In the case of a nitrogen oxide probe this amounts typically to 750° C. to 850° C.

A female connector 12 connects the interface, configured as a plug connector, to an energy source and through a system bus 111 to the motor controller 1. The system bus 111 is configured as a CAN bus.

At the interface 21 digital signals or pulse-width modulated (PWM) signals are delivered which are considered as digital signals in the meaning of the invention. These digital signals can easily be carried over great lengths in a motor compartment of a motor vehicle without problems, in contrast to the measurement signals of the exhaust gas probe 2.

Due to the use of a microprocessor in the evaluating unit 211 a long-lasting high accuracy of the electronics is achieved. In addition, manufacturing data on the exhaust probe 2 can be stored in the working memory of the microprocessor for correcting the measurement and control data.

On account of the digital interface 21 to the motor control apparatus 1, the number of the connecting lines 11 to the motor control apparatus can be definitely reduced. For example, there is no need for connecting lines for heating the probe. Two connecting lines 11 suffice as a system bus. Also, several units of sensors with evaluating units can be connected to a single system bus. The evaluating units must each have a bus controller. This function can be provided by the microprocessor of the evaluating unit 211.

What is claimed is:

1. A control system for an internal combustion engine, said system comprising:

a nitrogen oxide sensor, and and evaluating unit, a first connecting line for transmission of data from the sensor to the unit forming part of an interface for digitization of the data, a second connecting line for transmission of the digitized data from the unit to an engine control device, wherein said interface is a plug connector having a housing with the evaluating unit integrated therein, and said connector has a cooling surface with a thermal connection to at least one output component of the unit.

2. An exhaust gas sensor for an internal combustion engine comprising:

an exhaust gas probe electrically coupled to an interface, the sensor operable to transmit data to the interface via a connecting line, an evaluating unit forming a part of the interface, the evaluating unit operable to convert data from the probe into a digital signal, wherein the interface comprises a plug connector having a housing with the unit integrated therein, said housing including a water-repellant membrane operable to permit a supply of air through a second connecting line.

* * * * *